US011659902B2

(12) United States Patent
Ostasz et al.

(10) Patent No.: US 11,659,902 B2
(45) Date of Patent: May 30, 2023

(54) LOW PROFILE EXPANDABLE RING STRUCTURE

(71) Applicants: Marek Ostasz, East Rutherford, NJ (US); Dmitriy Klimov, Brooklyn, NY (US)

(72) Inventors: Marek Ostasz, East Rutherford, NJ (US); Dmitriy Klimov, Brooklyn, NY (US)

( * ) Notice: Subject to any disclaimer, the term of this patent is extended or adjusted under 35 U.S.C. 154(b) by 88 days.

(21) Appl. No.: 17/347,219

(22) Filed: Jun. 14, 2021

(65) Prior Publication Data

US 2021/0298433 A1 Sep. 30, 2021

Related U.S. Application Data

(62) Division of application No. 16/553,827, filed on Aug. 28, 2019, now Pat. No. 11,064,776.

(51) Int. Cl.
*A44C 9/02* (2006.01)

(52) U.S. Cl.
CPC ..... *A44C 9/02* (2013.01)

(58) Field of Classification Search
CPC ..... A44C 5/0069; A44C 5/0076; A44C 5/025; A44C 5/04; A44C 5/06; A44C 5/08; A44C 13/00; A44C 9/02; A44C 9/00
See application file for complete search history.

(56) References Cited

U.S. PATENT DOCUMENTS

| | | | |
|---|---|---|---|
| 311,722 | A | 2/1885 | Cottle |
| 1,515,499 | A | 11/1924 | Lederer |
| 1,660,438 | A | 2/1928 | Fielding |
| 2,667,739 | A | 2/1954 | Flaig |
| 2,753,682 | A | 7/1956 | Gerstenblith |
| 2,806,363 | A | 9/1957 | Manne |
| 2,902,749 | A | 9/1959 | Manne |
| 3,017,754 | A | 1/1962 | Manne et al. |
| 10,271,619 | B1 | 4/2019 | Peck |
| 10,306,957 | B2 | 6/2019 | Scandolaro |

*Primary Examiner* — Jack W Lavinder

(74) *Attorney, Agent, or Firm* — Myers Wolin, LLC

(57) ABSTRACT

Disclosed herein is a low profile expandable ring structure comprising a plurality of coupled blocks that each have a certain degree of translational movement with respect to each other. Each block has one or more downward curved loops or tubes protruding on the front side of the block which are inserted into openings on an adjacent block. A tensioned spring, passed through an internal channel of the coupled blocks, maintains the ring structure in a closed appearance but allows for expansion of the expandable ring structure through the translational movement of the blocks. The low-profile nature allows the expandable ring structure to be comfortable for the wearer.

16 Claims, 30 Drawing Sheets

100

LOW PROFILE EXPANDABLE RING STRUCTURE

CROSS REFERENCE OF RELATED APPLICATIONS

This application is a divisional of U.S. patent application Ser. No. 16/553,827, filed Aug. 28, 2019, the content of which is incorporated herein by reference.

FIELD OF THE INVENTION

The present invention relates to a low profile expandable ring structure which is expandable from a minimum size to a maximum size. More specifically, the present invention discloses an expandable ring structure comprising a plurality of coupled blocks having an internal spring which allows the ring structure to expand or contract as needed.

BACKGROUND

Typical rings are a completely fixed solid structure and each ring is made to a specific size for the wearer. While this does provide an adequate fit for the wearer. Most rings are made to be worn at the base of a given finger. The knuckles of the finger may be larger in circumference than the intended area for the ring so it can be difficult or uncomfortable to put on and vice versa. As a result, the ring may be slightly larger than the finger cross-section which would cause it to slide along the finger.

Similarly, most bracelets are rigid and considerably oversized in order to slip the bracelets over the wrist. While this method works, it causes an issue with a loose bracelet that can slide with ease or even slither through the wrist by accident. Therefore, a need exists for a ring structure that allows the bracelet or ring to conform to the cross section of the wrist or finger.

SUMMARY

The invention provides an expandable ring structure comprising a plurality of coupled blocks that each have a certain degree of translational movement with respect to each other. In a first embodiment, each block has one or more downward curved loops protruding on the front side of the block and an opening on the back side of the block. Each block also has one or more curved spring channels extending from the front side to the back side of the block. The loops from a block are inserted into the opening of the adjacent block and a pin inserted through the bottom of the top of the block couples them together. The length of the loop allows for translational movement between the blocks. A tensioned spring is inserted through the spring channels of the blocks, the spring channels forming a continuous, closed loop, and curved internal channel to the ring structure. The spring allow allowing for expansion and compression of the expandable ring structure. The springs also provide a compressive force to maintain a solid-like "closed" appearance unless stretched to accommodate the wearer's size. Once taken off, the expandable ring structure returns to its original solid-like shape. The low-profile nature allows the ring to be comfortable for the wearer.

In another embodiment, the front of each block comprises one or more downward curved tubes extending from a front surface of the block. Each tube has a curved internal channel that extends through to an opening in the back surface of the block. The tubes from a block are inserted into the channels of an adjacent block. A stopper is then coupled near an end of the tubes to prevent separation of the blocks. In this embodiment, the spring is internal to the tubes and the curved channel through the block.

DETAILED DESCRIPTION

Figure 4:
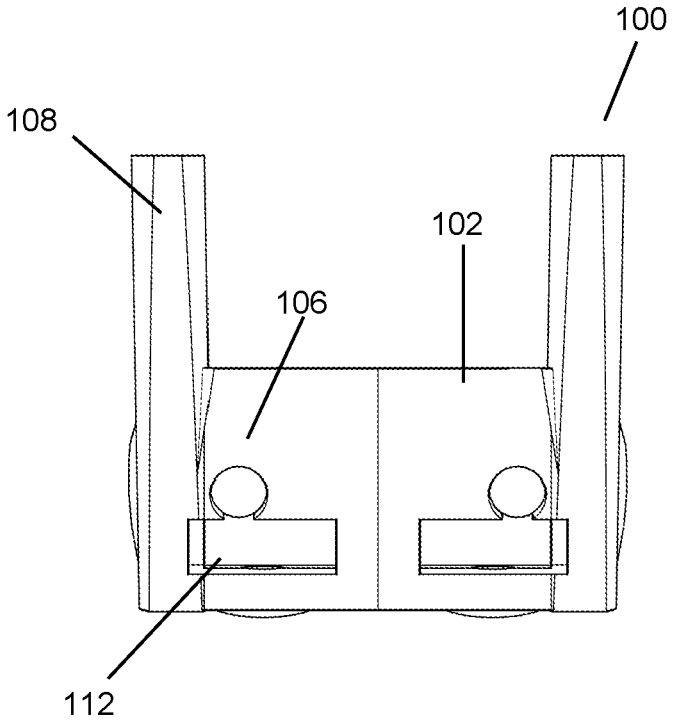
FIG. 4 depicts a rear view of the block of FIG. 1.
Figure 5:
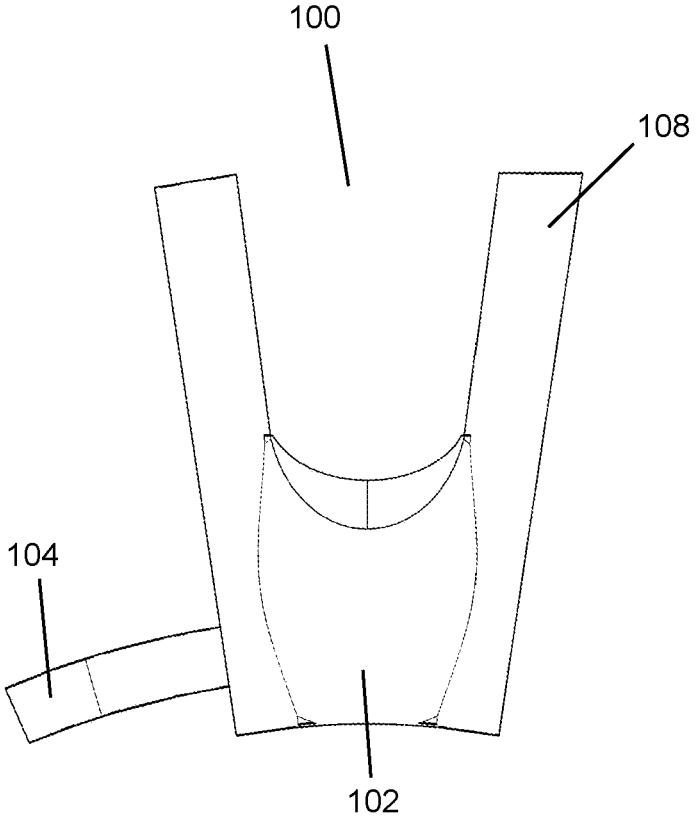
FIG. 5 depicts a right side view of the block of FIG. 1.

Referring simultaneously to FIGS. 1-7, depicted is a single block 100 according to a first embodiment of the invention. Each block 100 generally comprises body 102, loops 104, spring channels 106, prongs 108, pin holes 110, and loop openings 112. The loops 104 are generally U-shaped and extend from a front surface of body 102, preferably closer to the bottom surface of the body 102 than the top surface. As best shown in FIG. 5, each loop 104 is downward curving. The angle traversed by the curved bottom surface of each block 100 depends on the number—N—of blocks required to complete the ring structure and is approximately 360/N.

Body 102 is generally prism shaped with a hollow center according to a preferred embodiment of the invention. As shown in FIG. 5, a bottom surface of body 102 is curved. Thus, when a plurality of block 100 are joined together, they will form a smooth ring structure, especially when in the collapsed state, due to the curvature of the bottom surface of body 102. The top surface of body 102 is wider than the bottom surface, otherwise sizable gaps, and other internal components, would be visible in the expandable ring structure. The opposing side surfaces of body 102 preferably have the same decoration and construction as depicted in FIGS. 1 and 2.

Figure 1:
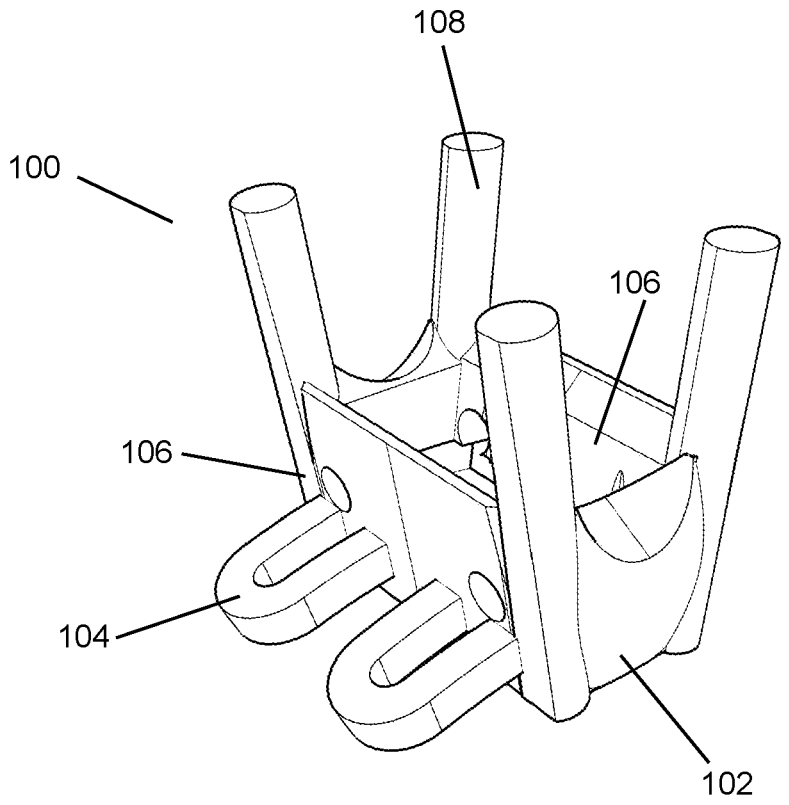
FIG. 1 depicts a front perspective view of a block of the expandable ring structure of a first embodiment of the present invention.
Figure 2:
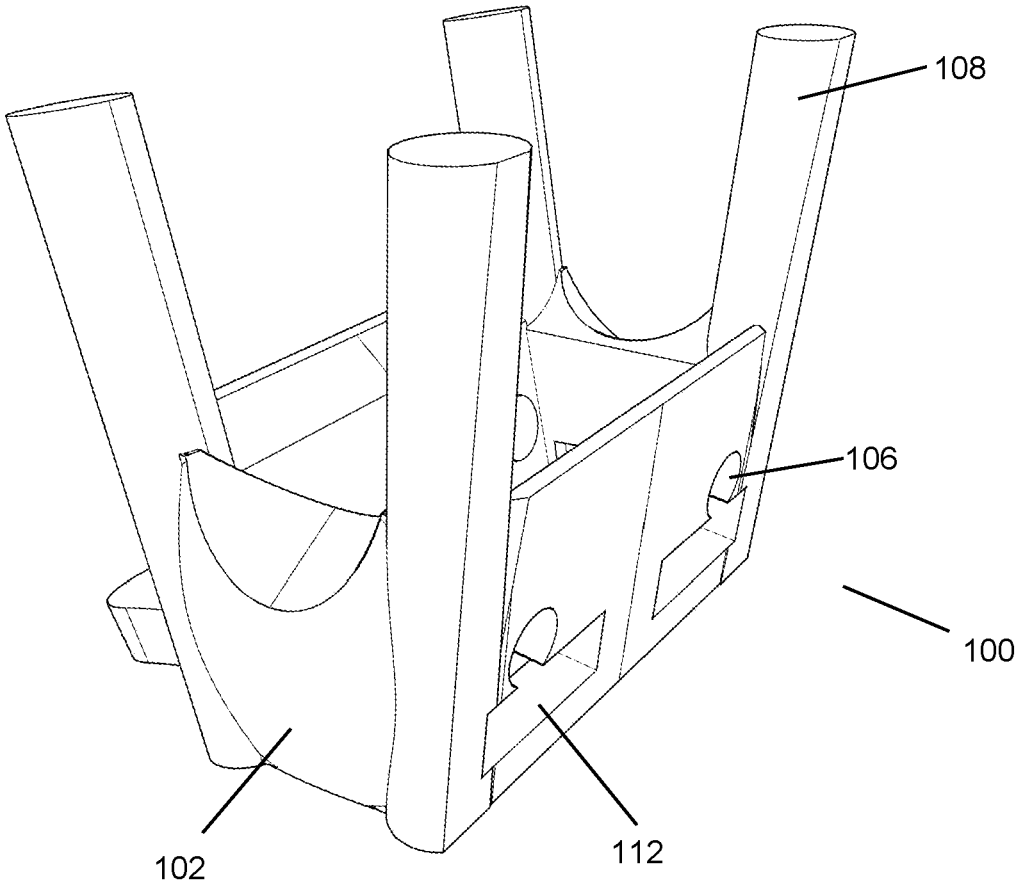
FIG. 2 depicts a rear perspective view of the block of FIG. 1.
Figure 3:
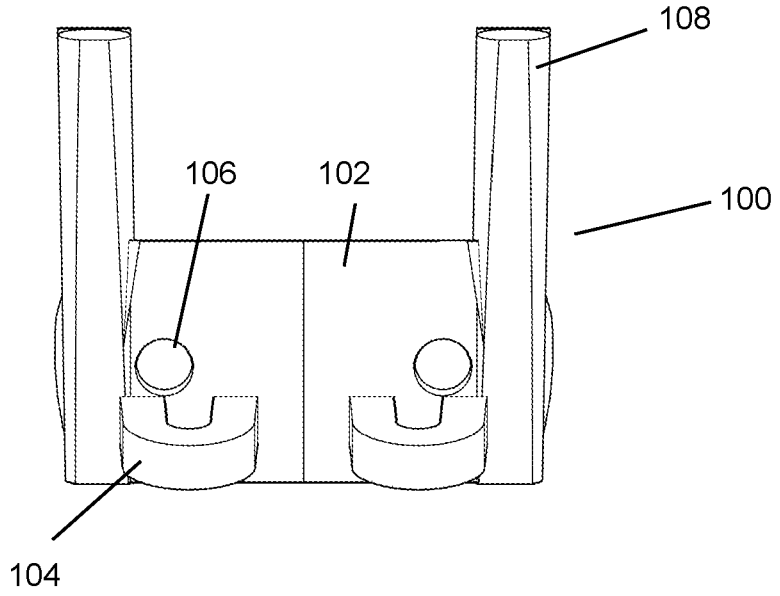
FIG. 3 depicts a front view of the block of FIG. 1.

In the depicted embodiment, each spring channel 106 is formed from openings in the front surface and rear surface of body 102 as depicted in FIGS. 1 and 2. In order to reduce the weight of body 102 and for ease of manufacturing, the center of the body 102 is preferably open/hollow as shown in FIG. 1. However, if body 102 is solid, then spring channel 106 would extend entirely through body 102 and be curved. Spring channel 106 has a diameter only slightly larger than a diameter of the spring that is later placed therein to complete the expandable ring structure.

A plurality of prongs 108 preferably extend from a top surface of body 102 as depicted. The prongs 108 are used to secure gemstones to the block if needed. Otherwise, prongs 108 may also be removed and the top surface of body 102 may be flat if a very low profile piece is desired (i.e., only having a thickness the same as body 102).

Figure 6:
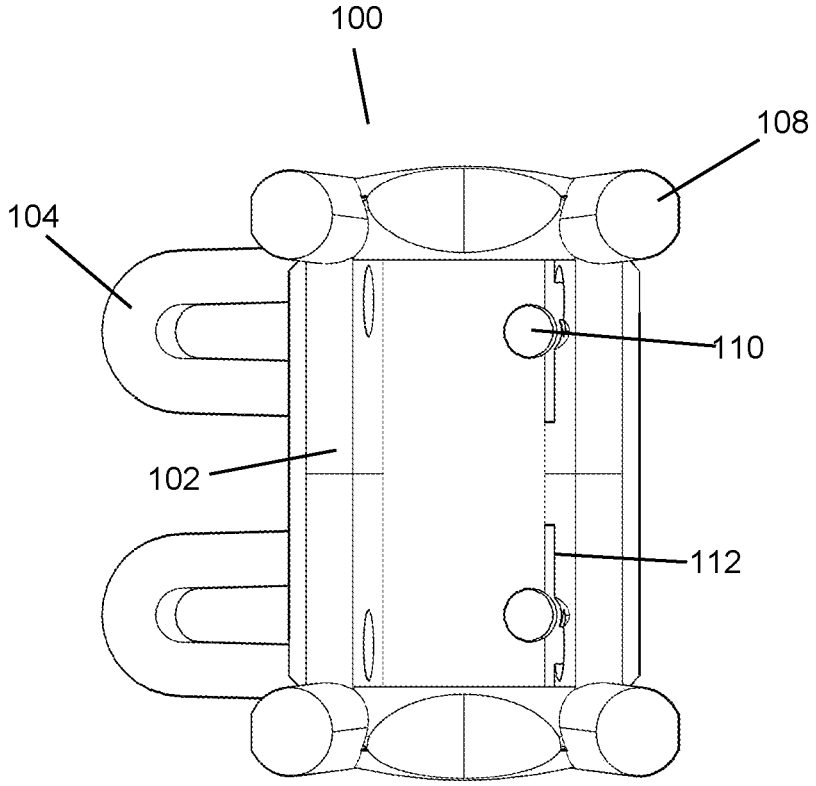
FIG. 6 depicts a top view of the block of FIG. 1.
Figure 7:
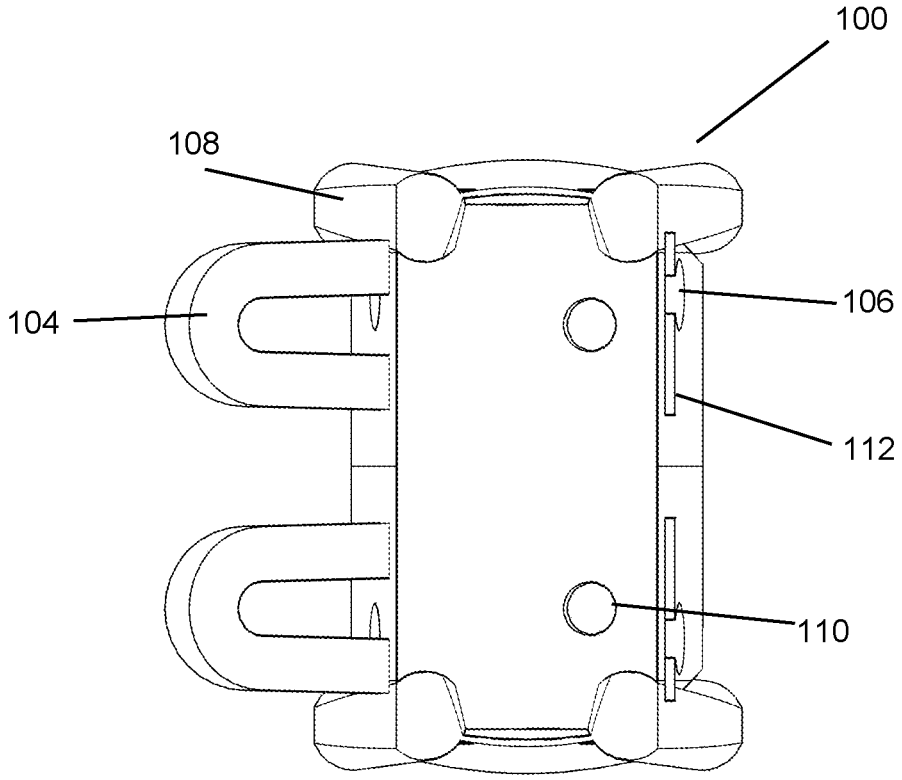
FIG. 7 depicts a bottom view of the block of FIG. 1.

As best depicted in FIGS. 6 and 7, the bottom surface of body 102 comprises pin holes 110 whose center is aligned with a center of loop openings 112. As will be depicted later, pins are inserted through pin holes 110 to join adjacent blocks 100 to each other.

FIGS. 2 and 4 depict loop openings 112 which are sized and spaced to accommodate loops 104 from an adjacent block 100. In the depicted embodiment, loop openings 112 and spring channel 106 share a common opening on the rear surface of body 102. However, as should be obvious to one skilled in the art, the location and spacing of spring channels 106 can be modified.

Figure 8:
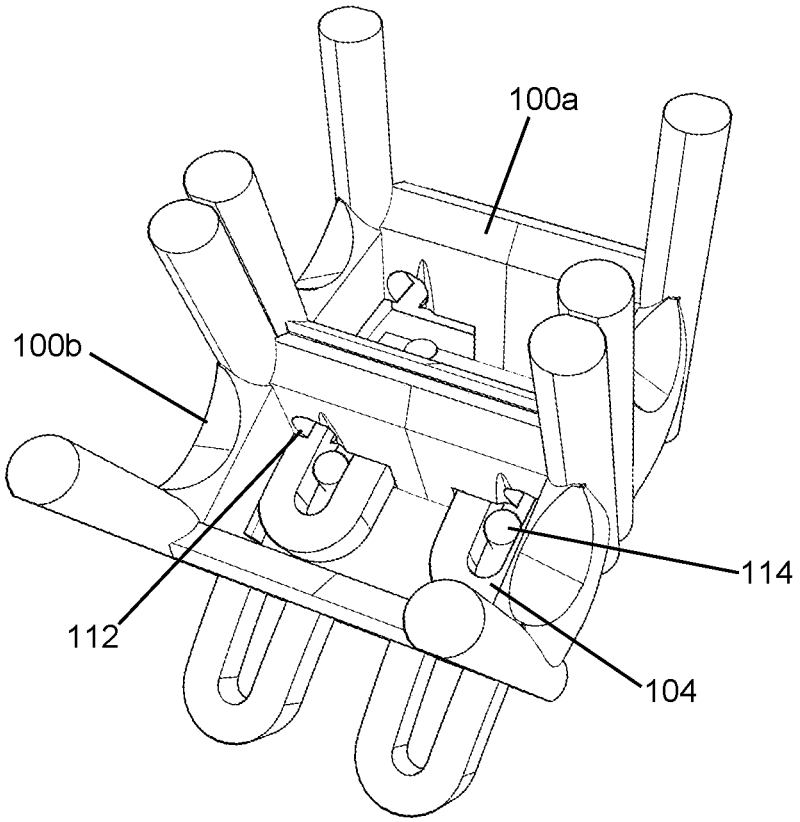
FIGS. 8 and 9 depict the coupling of two adjacent blocks of the expandable ring structure.
Figure 9:
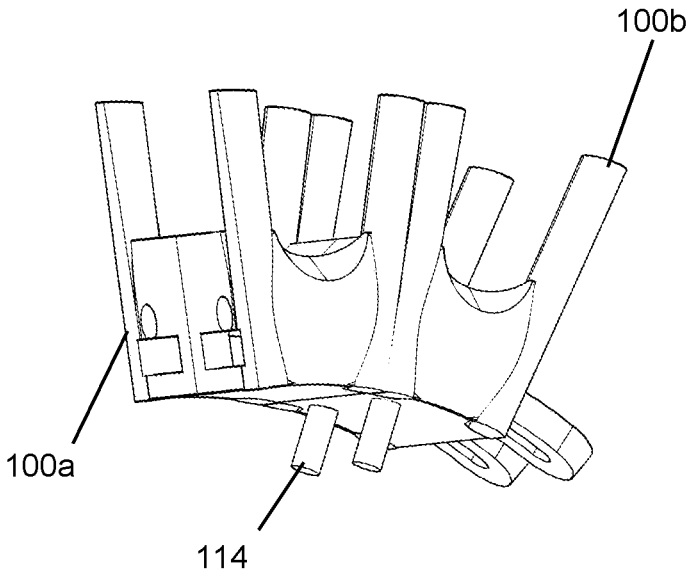

Turning next to FIG. 9, depicted is an example of how adjacent blocks 100*a* and 100*b* are coupled to each other in the expandable ring structure. Loops 104 of a first block 100*a* are inserted into loop openings 112 of a second and adjacent block 100*b*. Two pins 114 are then inserted through pin holes 110 of block 100*b* until they intersect with loops 104 of block 100*a*. The pins 114 may be inserted from the top surface or the bottom surface of body 102 of block 100*b*. After the pins 114 have been placed at the correct height (level with height of loops 104) as depicted in FIG. 8, they are fixed (e.g., by soldering or laser) into position. The remainder of the pin 114 exiting pin holes 110 (FIG. 9) can then be removed (e.g., by laser cutting) to create a smooth band polished bottom surface for body 102 of block 100*b*. The length of loops 104 allows for translational movement between block 100*a* and 100*b* but pins 114 prevent them from becoming separated and limits the maximum translational movement distance. This process is repeated for the majority of blocks 100 which are to form the expandable ring structure.

Figure 10:
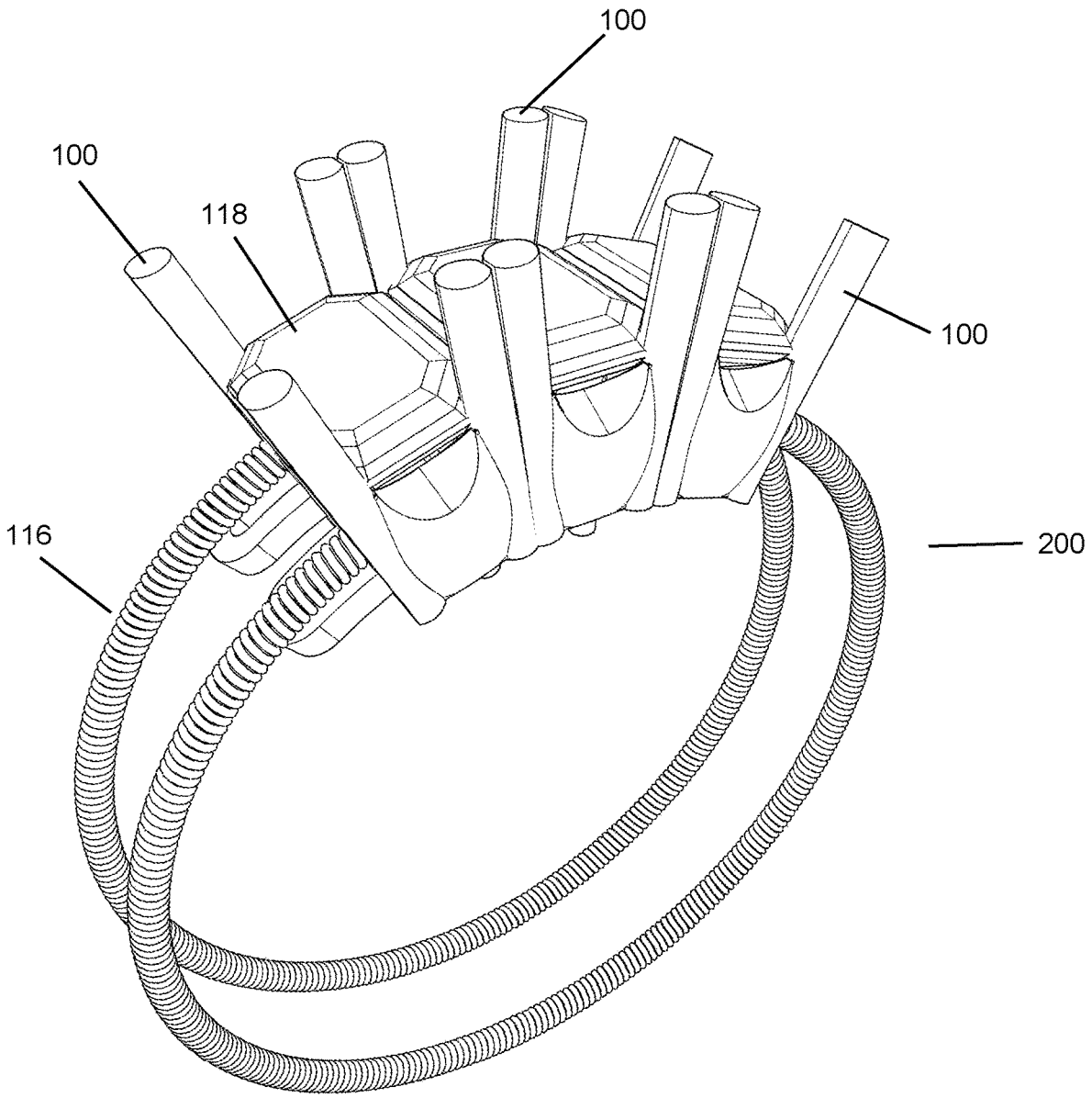
FIG. 10 depicts the placement of the springs passing through the spring openings of the blocks.

For illustration purposes, FIG. 10 depicts three blocks 100 joined together with two springs 116 passed through spring channels 106 of blocks 100. Here, it can be clearly seen how the bottom curved surfaces of blocks 100 form expandable ring structure 200 having a smooth curved interior, similar to a standard ring. Also, as previously mentioned, the front and rear surfaces of body 102 and prongs 108 are angled outward from the bottom surface so that expandable ring structure 200 also forms a smooth, connected outer surface when not expanded. Jewels 118 are preferably not secured by prongs 108 until the entire expandable ring structure 200 has been completed. One spring 116 may also be utilized, or three or more springs 116 depending upon the size of expandable ring structure 200. Two or more springs 116 has the advantage that the force from springs 116 is more evenly distributed across the piece.

As long as the spring channels 106 for the springs 116 are nestled between the culets of the gems 118, this reduces the profile of the expandable ring structure ring to mimic a conventional rigid ring. The wall height of body 102 are proportional to the gems used so the expandable ring structure can mimic the weight and feel of a conventional ring.

Figure 11:
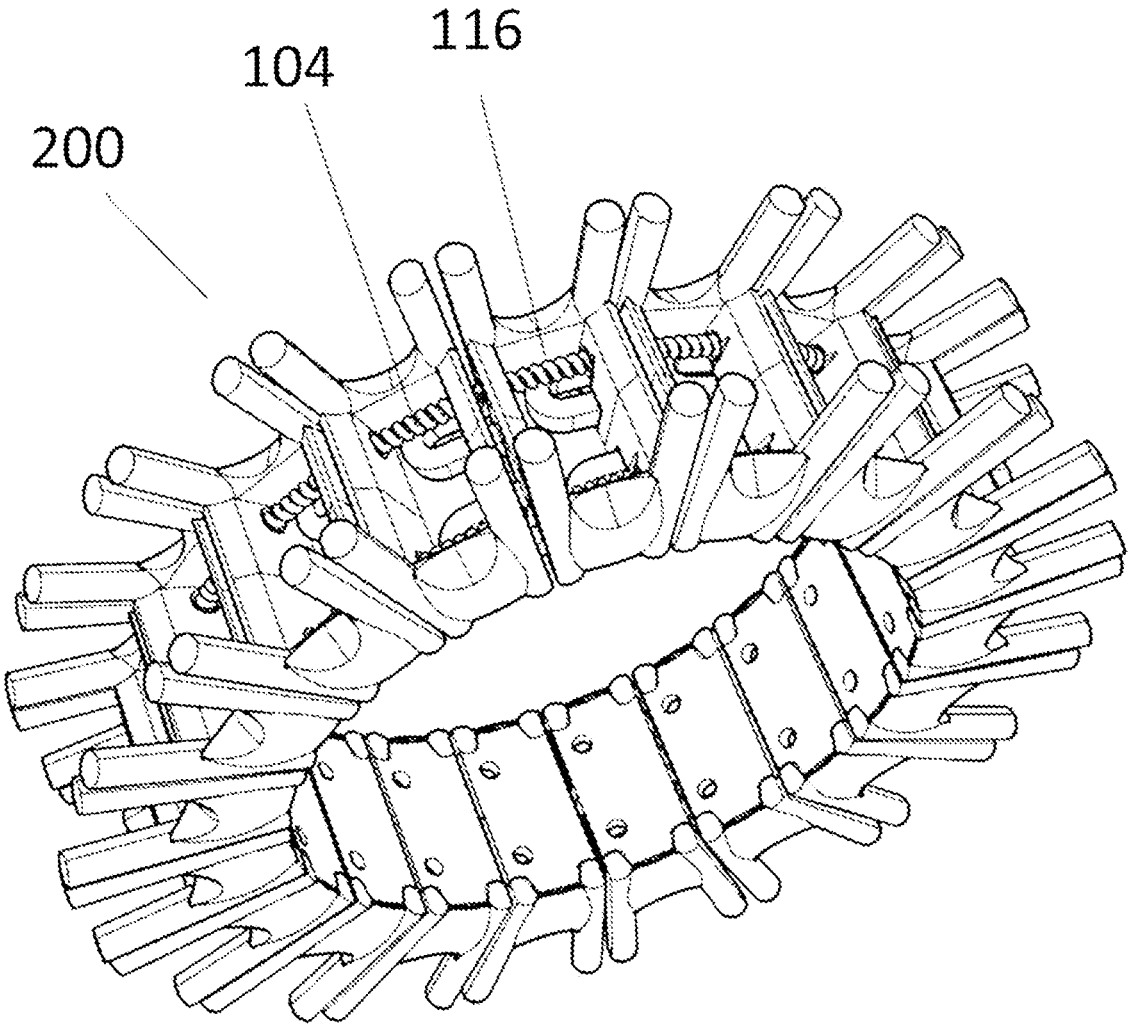
FIG. 11 depicts a perspective view of a completed expandable ring structure according to the first embodiment.
Figure 12:
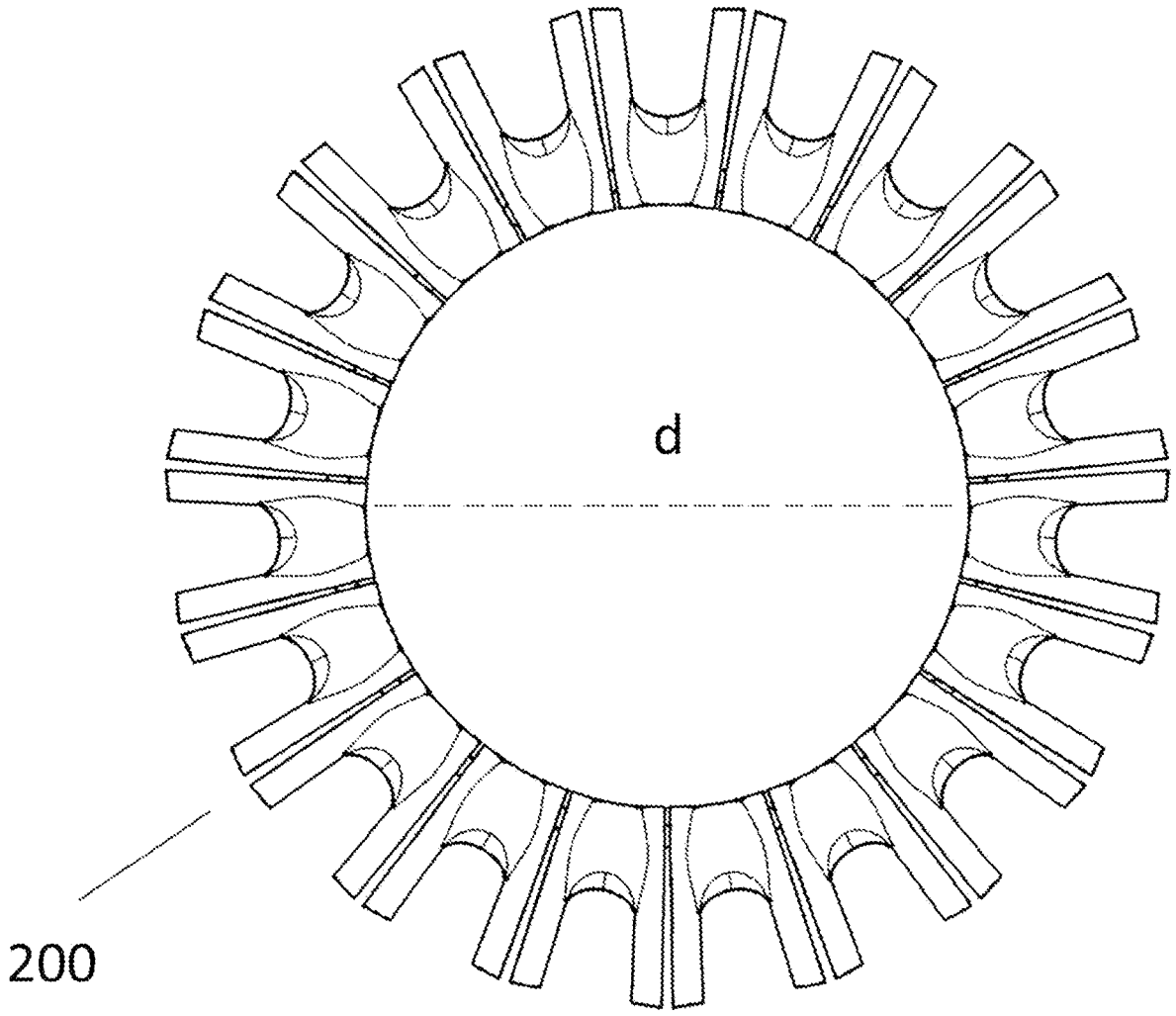
FIG. 12 depicts a side view of a completed expandable ring structure according to the first embodiment.

FIGS. 11 and 12 depict views of the completed expandable ring structure 200 according to the first embodiment. Here, the expandable ring structure 200 comprises 19 separate blocks 100, with the bottom surface of the body having a radius of curvature of approximately 360°/19. Further, each bottom surface of body 102 has an arc length of approximately (n*d)/N with d being the internal diameter of the expandable ring structure 200 and N being the number of blocks 100 (i.e., 19 in this example). FIG. 11 depicts how pins 114 are cut so they are flush with the bottom surface of body 102 for each block 100. This view also depicts how springs 116 pass through spring channels 106 in each block 100. And, as depicted in FIG. 12, the internal surface of expandable ring structure 200 forms a ring and would not feel any different to a user than a standard ring during wear. In fact, expandable ring structure 200 is more comfortable because it can adjust to the user to accommodate swelling, aging, etc. as well as any possible expansion or contraction of the components of expandable ring structure 200 due to heat, humidity, wear, etc.

To form the expandable ring structure 200, the following process is preferably utilized. First, all the blocks 100, except the first and the last, are joined together using pins 114 as already described. One end of the springs 116 is fixed to the first block 100, passed through all spring channels 106, and then stretched and secured to the interior of the last block 100. The first and last block are then permanently joined together by soldering or laser welding. At this point, expandable ring structure 200 can be finished with jewels 118 to produce a finished piece of jewelry.

Block 100 is preferably formed as a unitary piece by casting in a mold. When used for jewelry, block 100 is preferably formed from a precious or semi-precious metal such as silver, gold, platinum, titanium, etc. However, other metals such as steel may be used and then provided with a coating or plating of another metal, such as gold.

Figure 13:
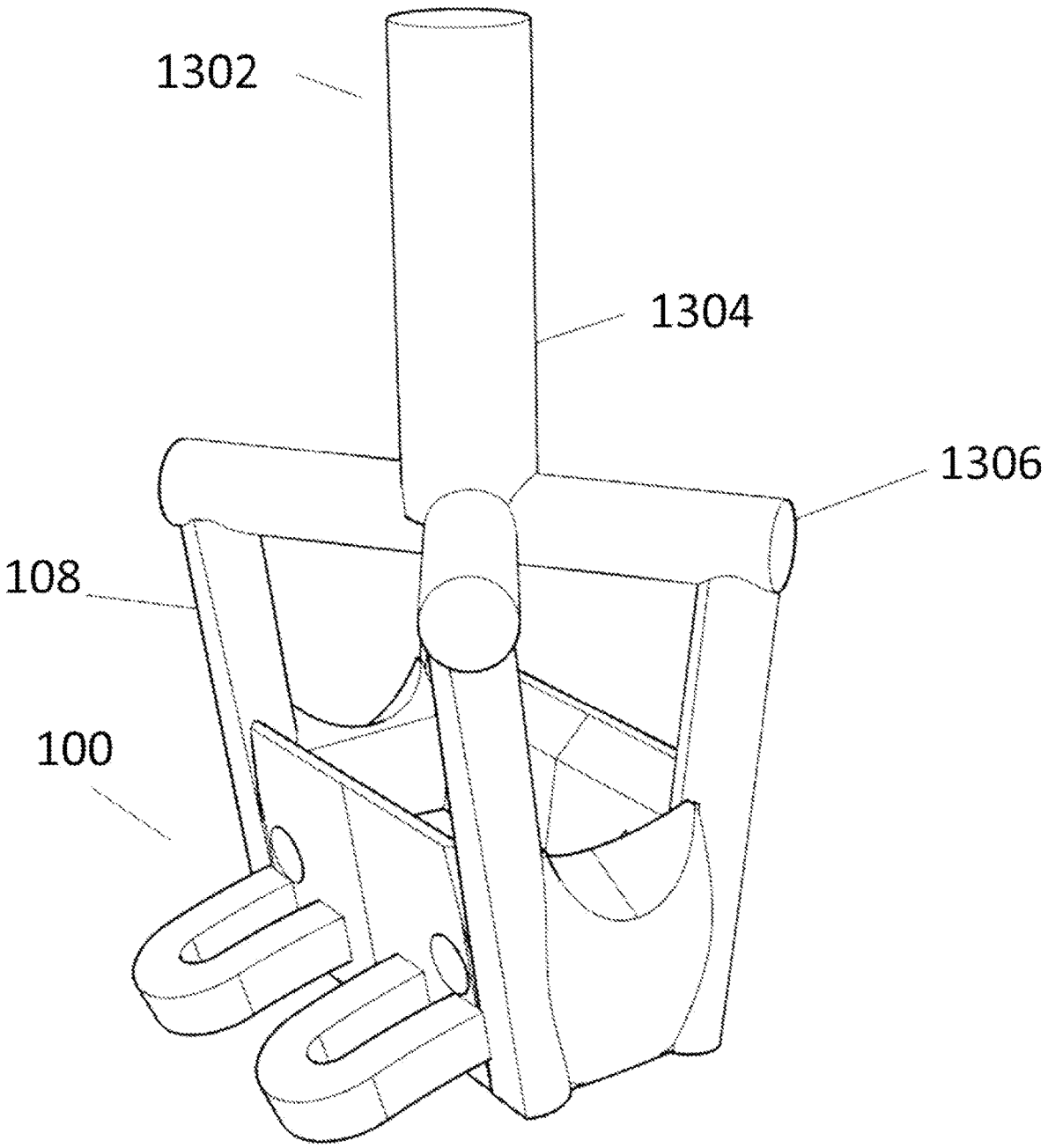
FIGS. 13 and 14 depict views of a block coupled to a sprue.
Figure 14:
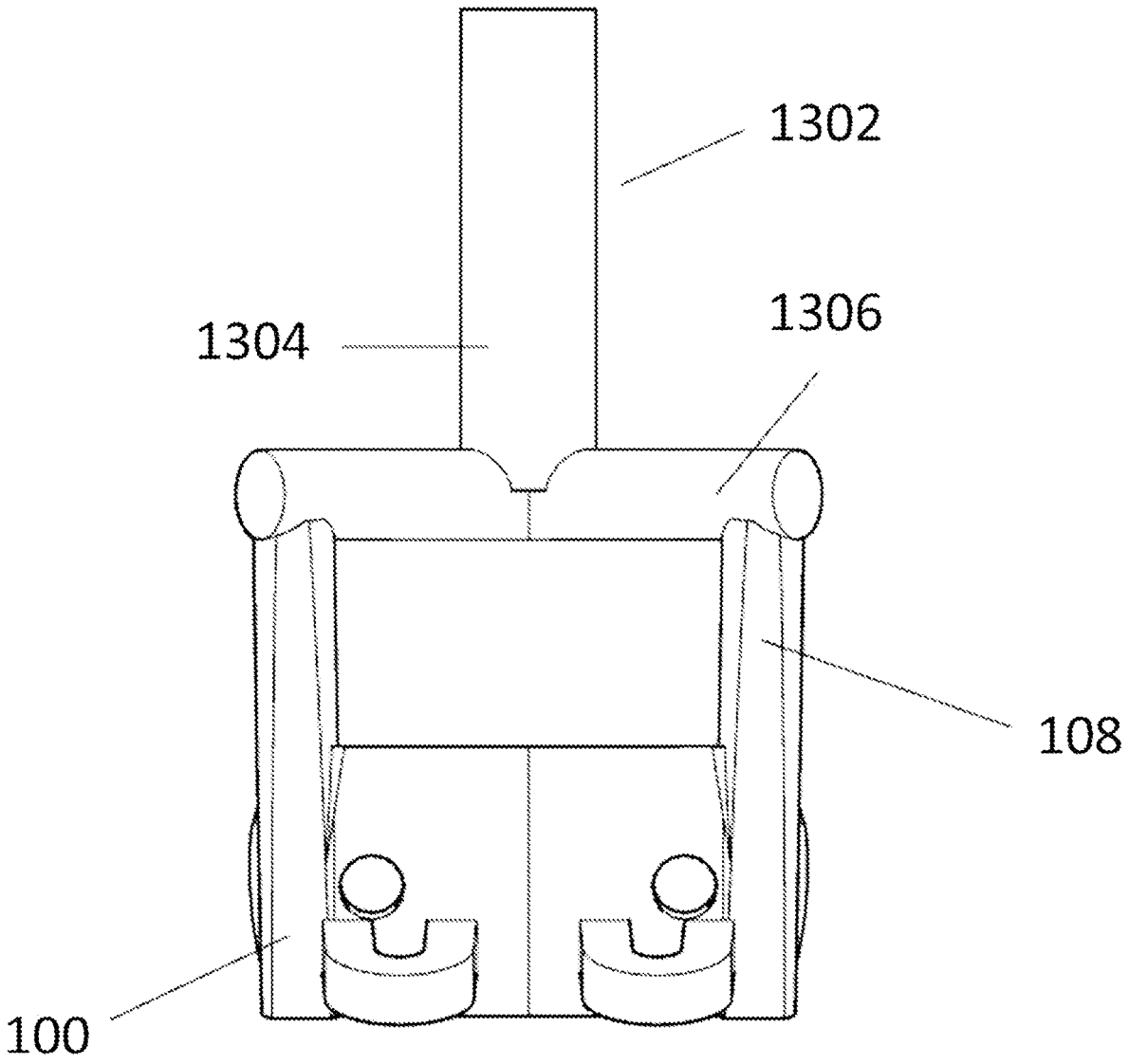

Because block 100 is preferably made by casting, it is preferably to cast block 100 having an attached sprue 1302 as depicted in FIG. 13. The sprue 1302 generally comprises post 1304, which can be used for handling block 100 during assembly of expandable ring structure 200 (e.g., for holding or clamping) and cross 1306 having ends attached to prongs 108. The sprue 1302 allows the blocks 100 to be produced more easily and they can easily later be severed and cleaned. Once severed, gems or jewels 118 can be added to expandable rings structure 200 to produce the finished piece.

Figure 15:
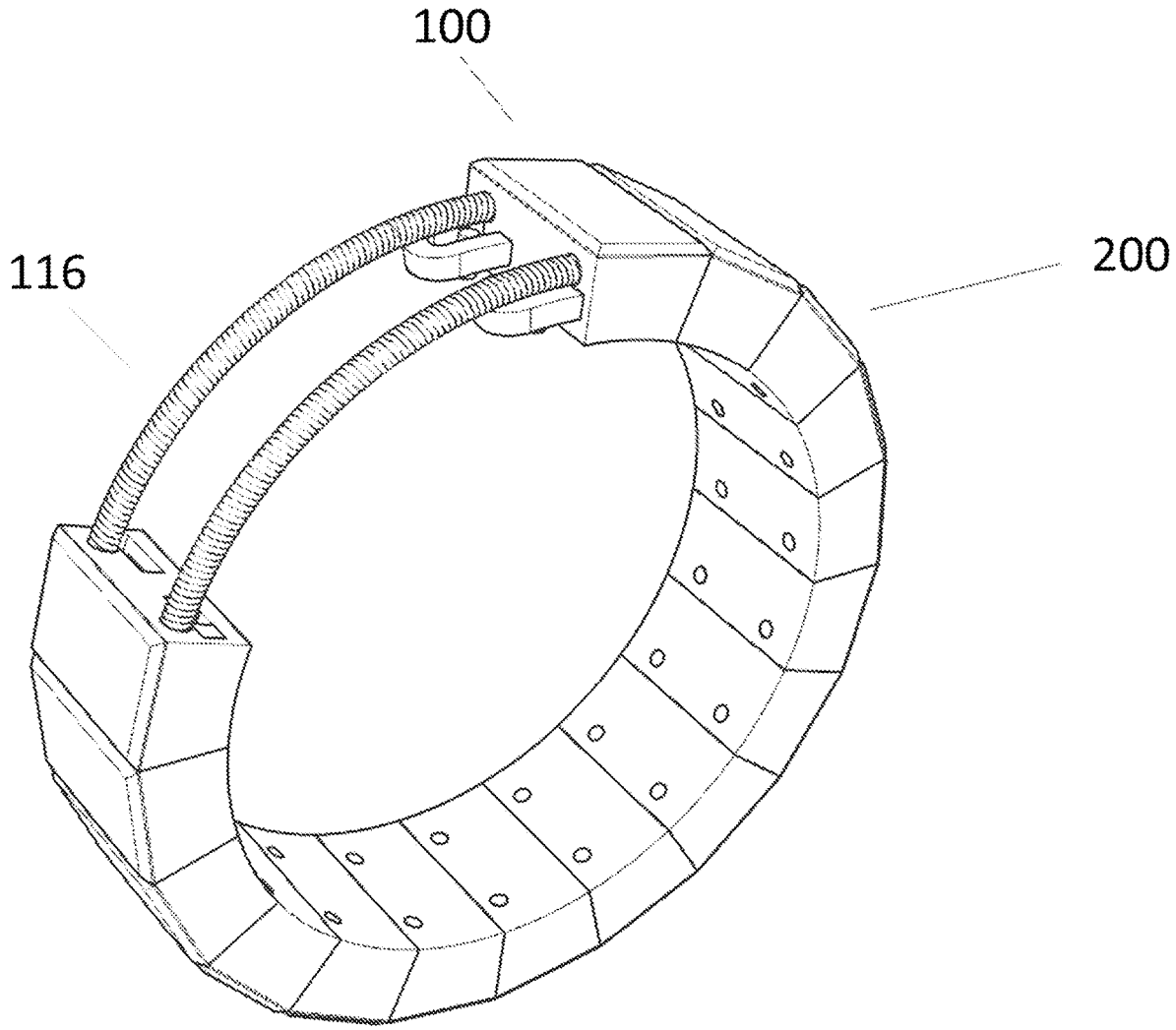
FIGS. 15 and 16 depict views of the expandable ring structure of FIG. 1 without prongs.
Figure 16:
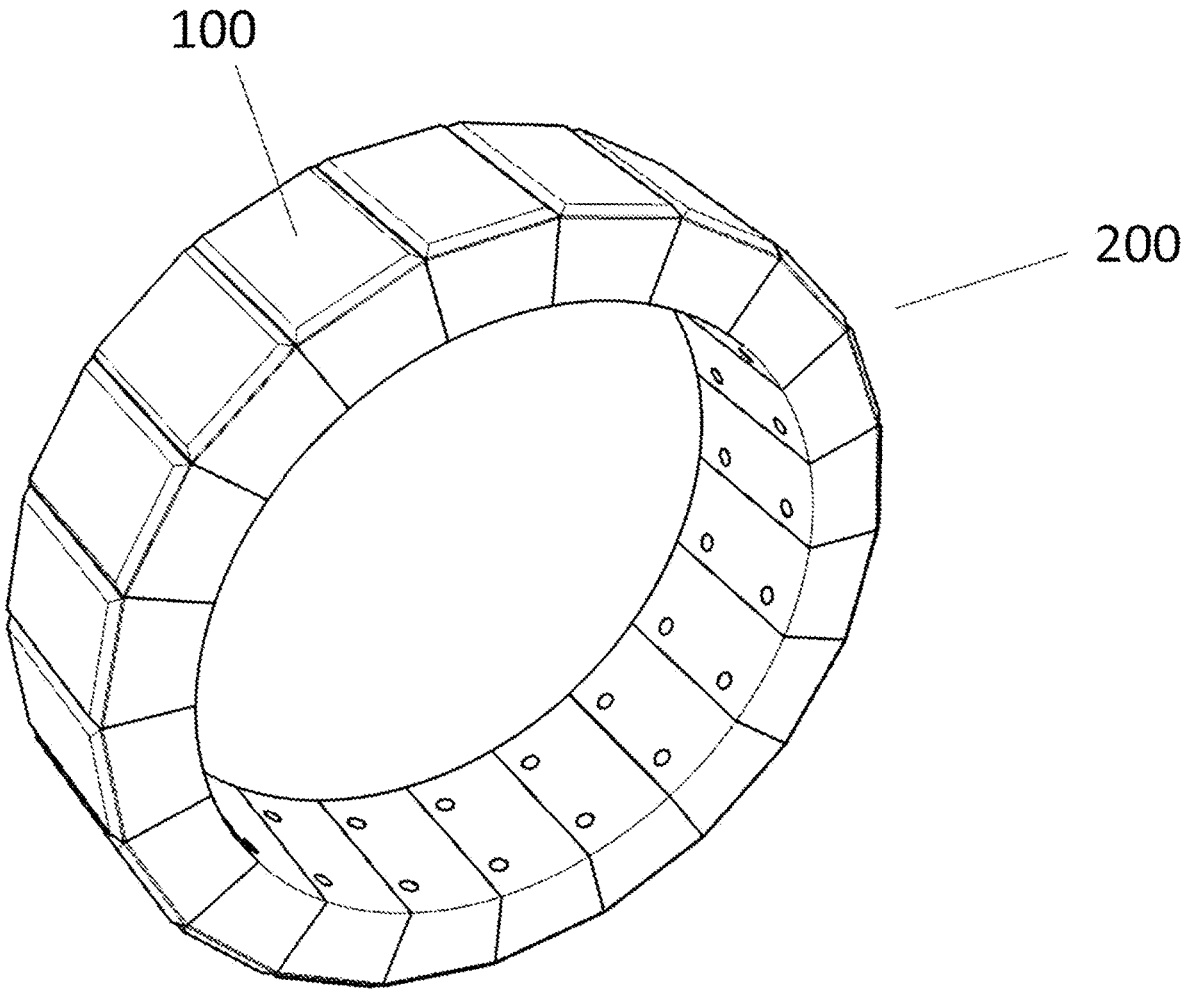

FIGS. 15 and 16 depict the block 100 of FIG. 1 without any prongs 108. This structure has a very low profile, similar to a ring unadorned with gems, while still being expandable.

FIG. 16 especially depicts how the thickness of expandable ring structure 200 is reduced with the removal of prongs 108. FIG. 15 depicts the block 100 having a flat and smooth top without any prongs 108 or gems 118

Figure 17:
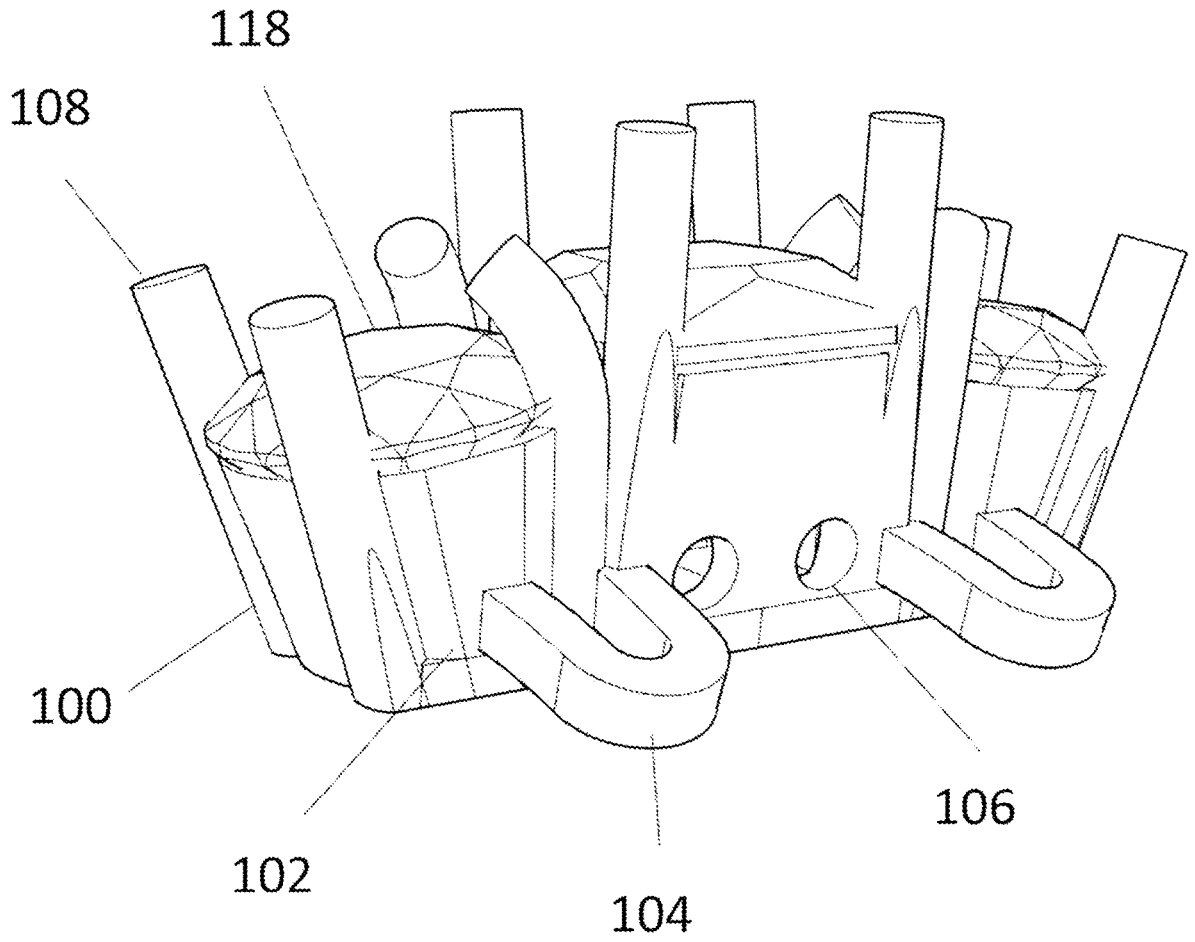
FIG. 17 depicts a perspective view of an alternate embodiment of the block of FIG. 1.
Figure 18:
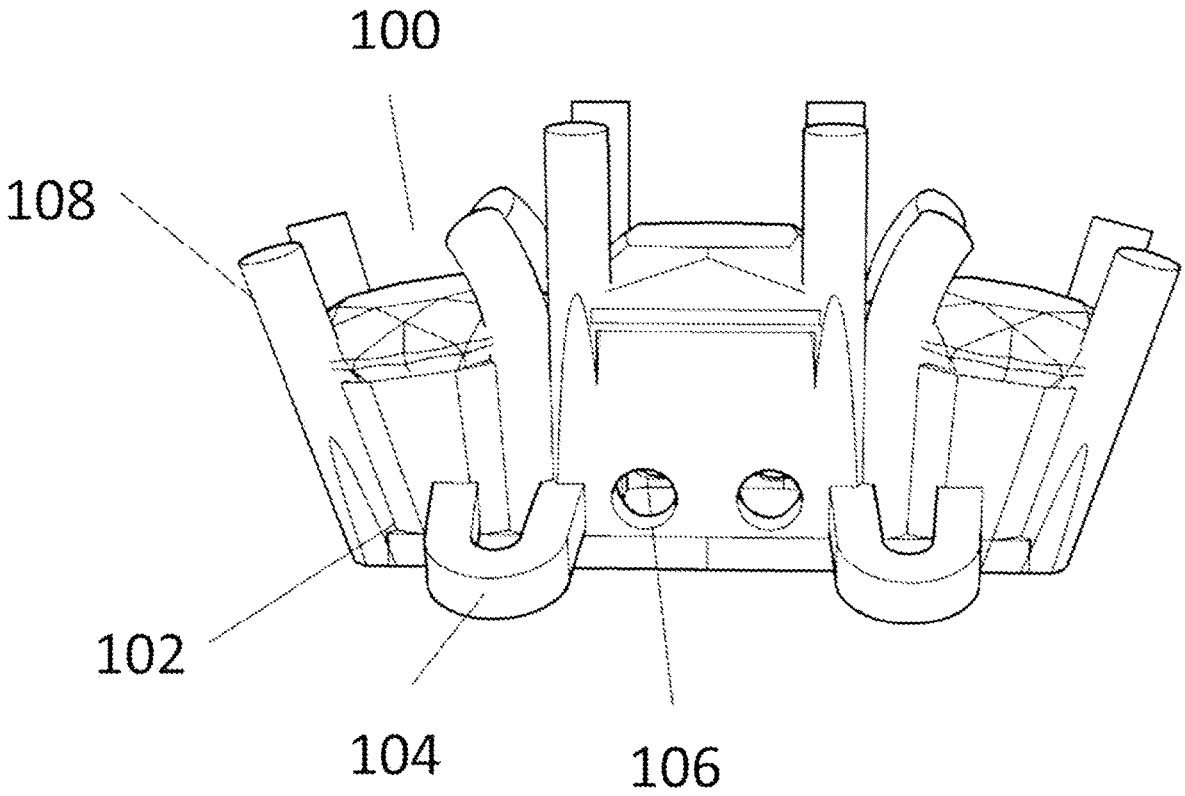
FIG. 18 depicts a front view of an alternate embodiment of the block of FIG. 1.
Figure 19:
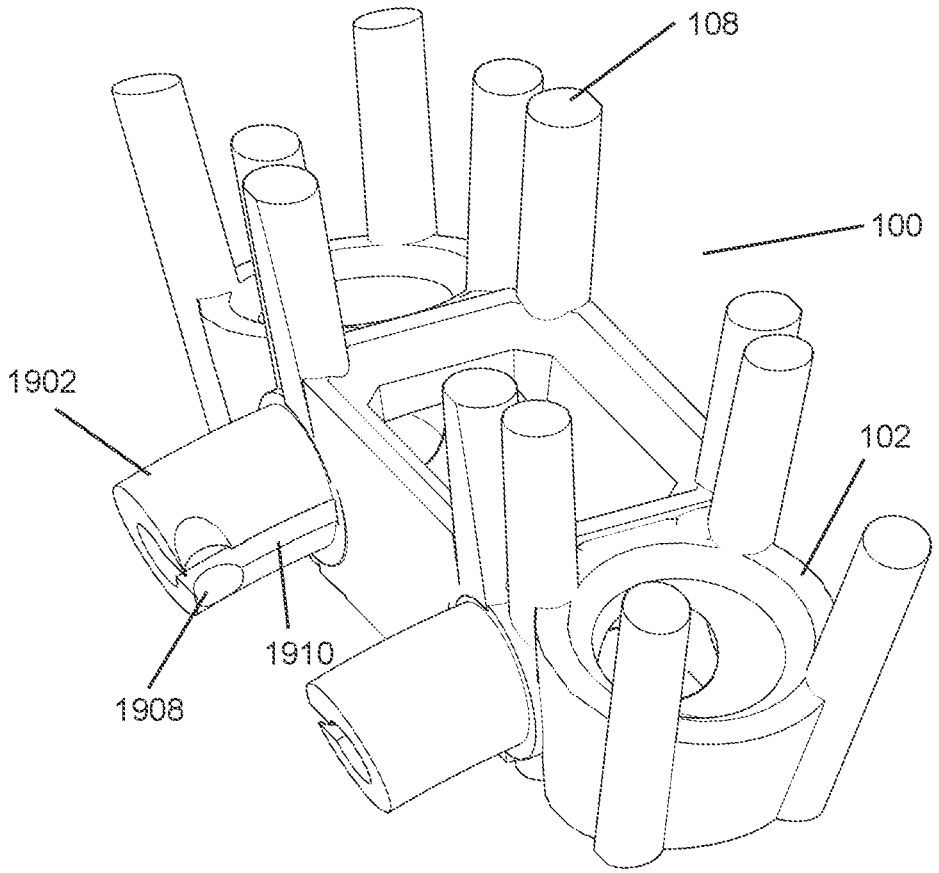
FIG. 19 depicts a front perspective view of a block of the expandable ring structure of a second embodiment of the present invention.

FIGS. 17 and 18 depict an alternate embodiment of the block 100. In this embodiment, block 100 is much wider than that shown in FIG. 1 and is capable of holding multiple gems 118 in prongs 108. This embodiment of block 100 is useful for producing larger jewelry, such as bracelets which typically hold more gems 118 than a ring. In this embodiment, spring channels 106 are located close to the center of body 102 and loops 104 are located immediately adjacent spring channels 106. The wider spacing of loops 104 helps to provide torsional rigidity to the finished expandable ring structure 200.

It should be obvious that the width of body 102 can be increased to accommodate even more gems 118 than shown in FIGS. 17 and 18. Further, it should also be obvious that additional spring channels 106 and/or loops 104 can be provided for extra stability in expandable ring structure 200.

Figure 22:
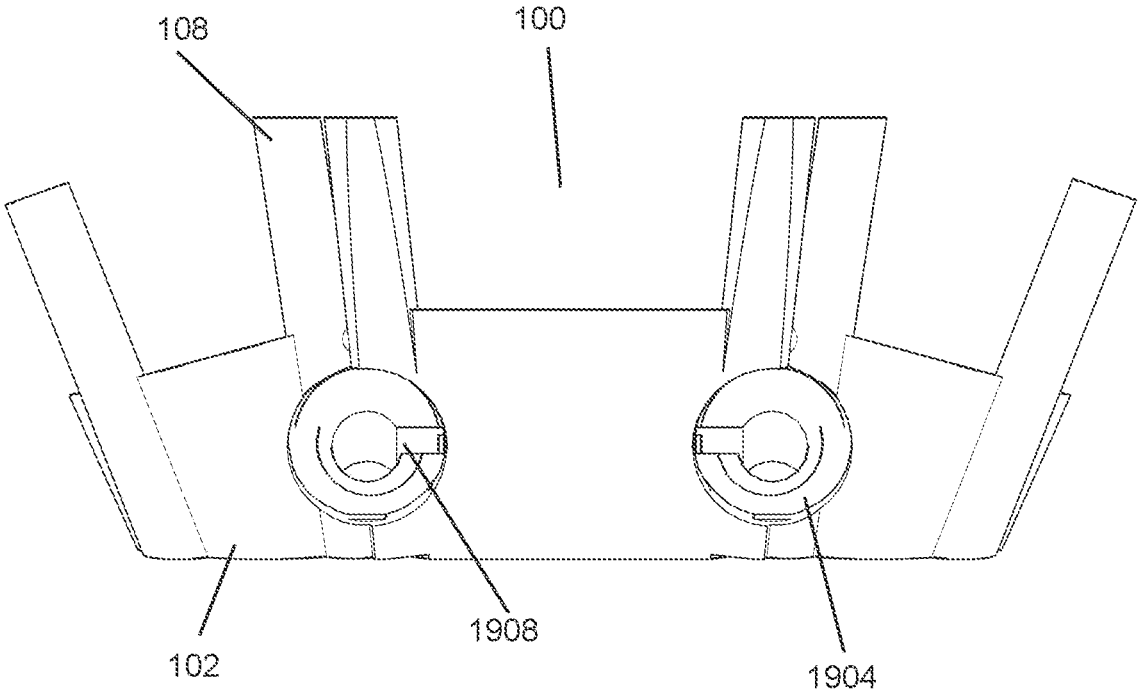
FIG. 22 depicts a rear view of the block of FIG. 19.
Figure 23:
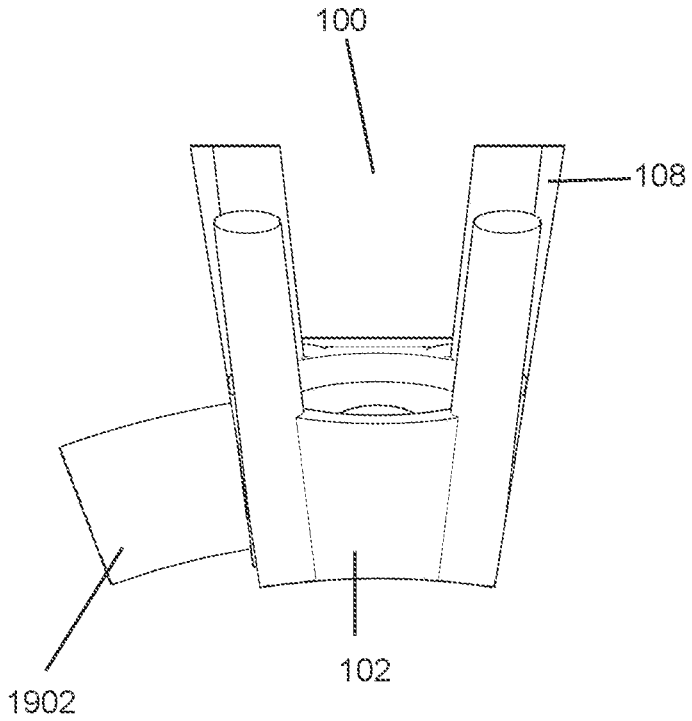
FIG. 23 depicts a right side view of the block of FIG. 19.
Figure 24:
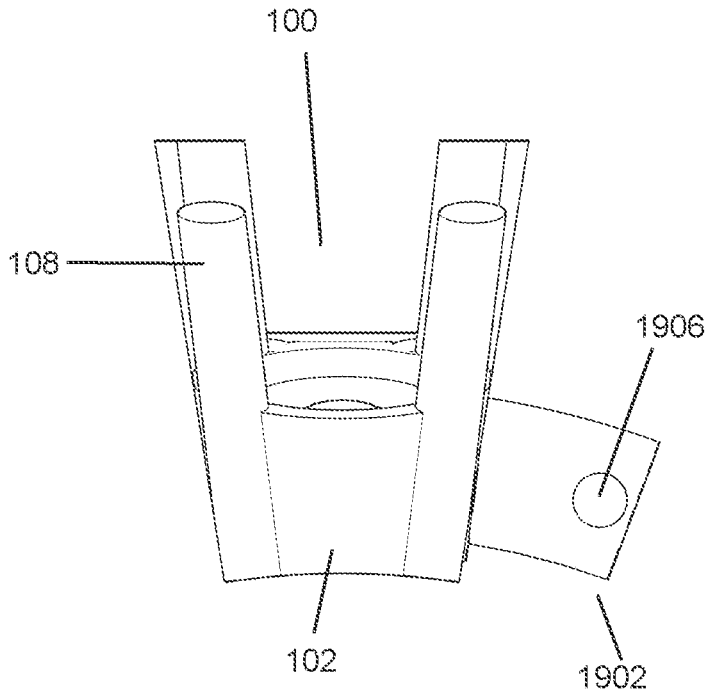
FIG. 24 depicts a left side view of the block of FIG. 19.
Figure 25:
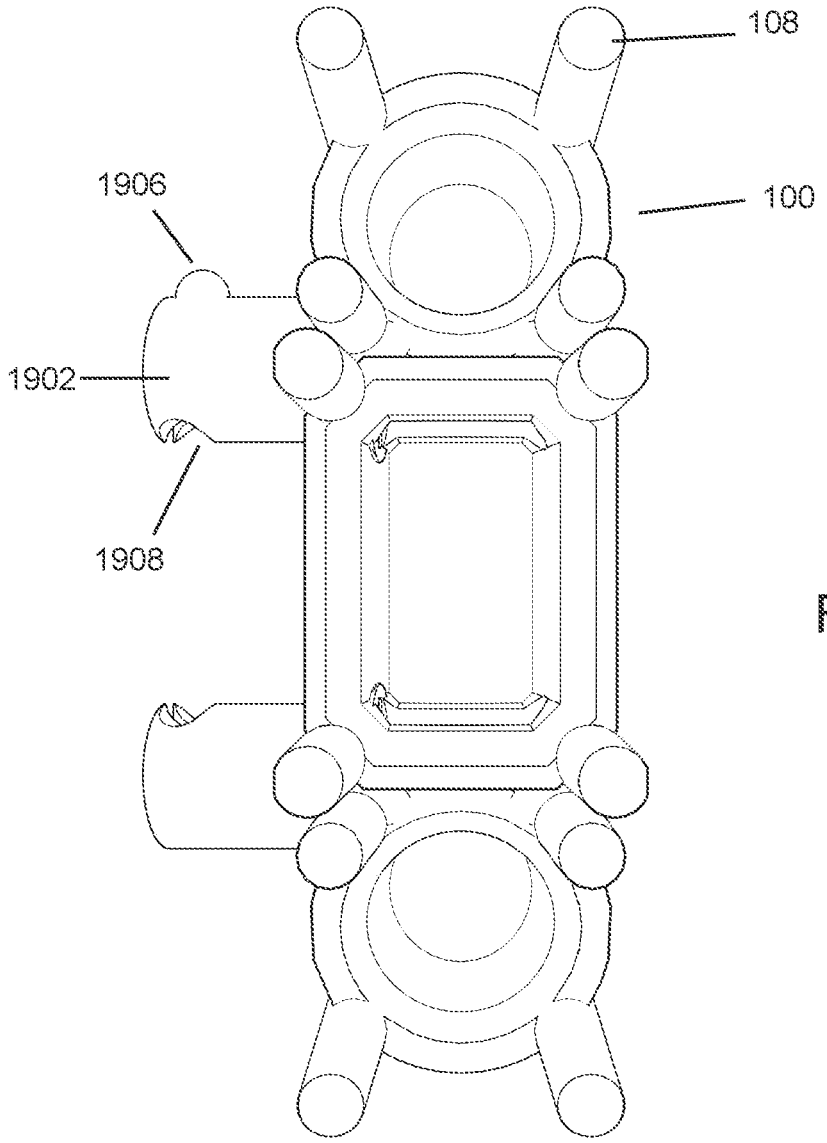
FIG. 25 depicts a top view of the block of FIG. 19.
Figure 26:
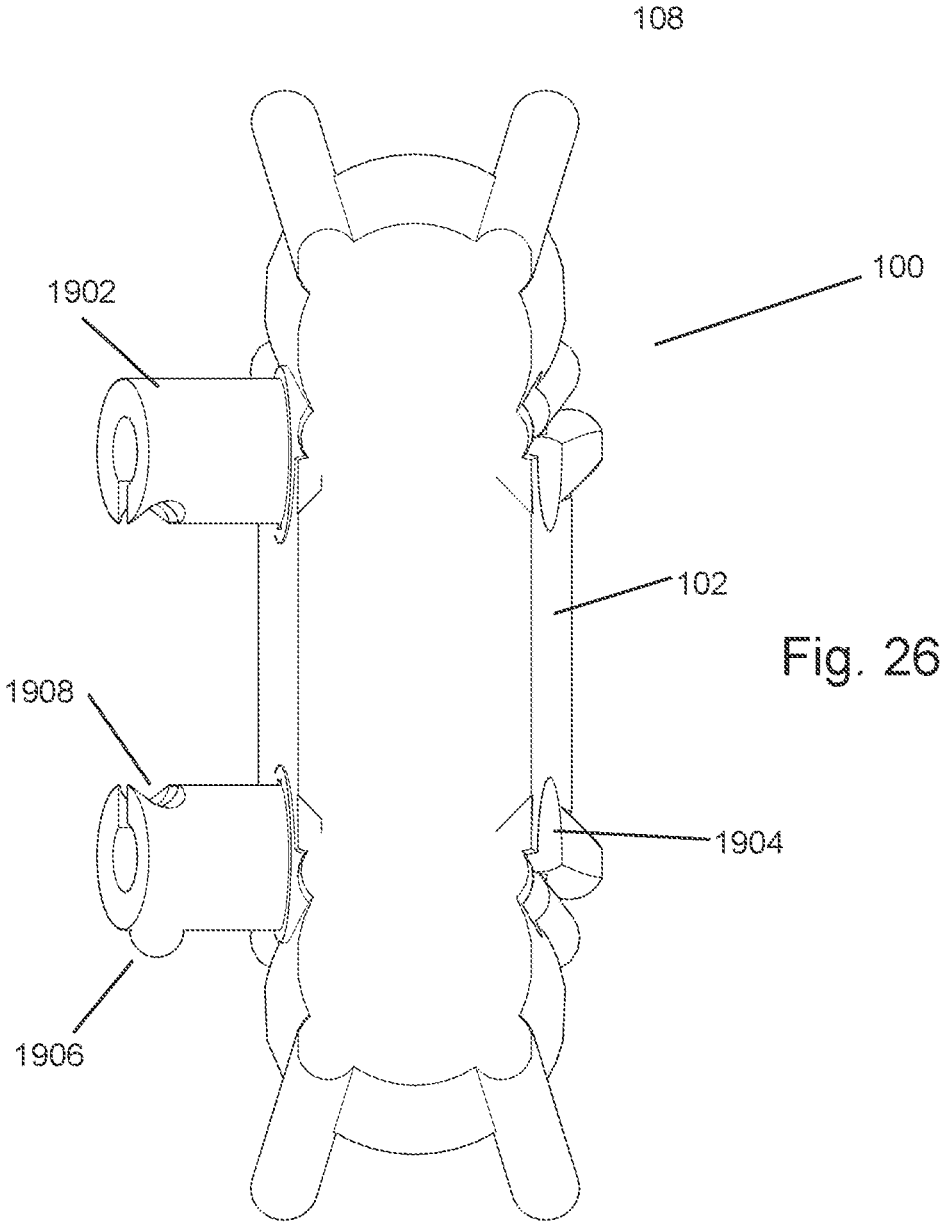
FIG. 26 depicts a bottom view of the block of FIG. 19.

Turning next to FIGS. 19-26, depicted is a second embodiment of block 100. In this embodiment, the size, shape, and curvature of body 102 may be the same as those depicted in FIGS. 1-18. Similarly, the prongs 108 are similar and the body block 100 may comprise one jewel 118 or retain the ability to hold multiple jewels 118 as shown in this embodiment. However, the mechanism which joins blocks 100 to each other in this embodiment. Instead of loops 104, this embodiment employs two tubes 1902 which extend from a front face of body 102. Similar to loops 104, the tubes 1902 are curved downward as best shown in FIGS. 23 and 24. The tubes 1902 are preferably much thicker than loops 104 and are greater than half the thickness of the expandable ring structure 200. The tubes 1902 may be circular or oval in shape. The inner diameter of tubes 1902 must be greater than the spring 116 which is placed there through when ring structure 200 is formed. This provides a great amount of stability for use in larger/heaver pieces of jewelry such as bracelets or necklaces.

Figure 20:
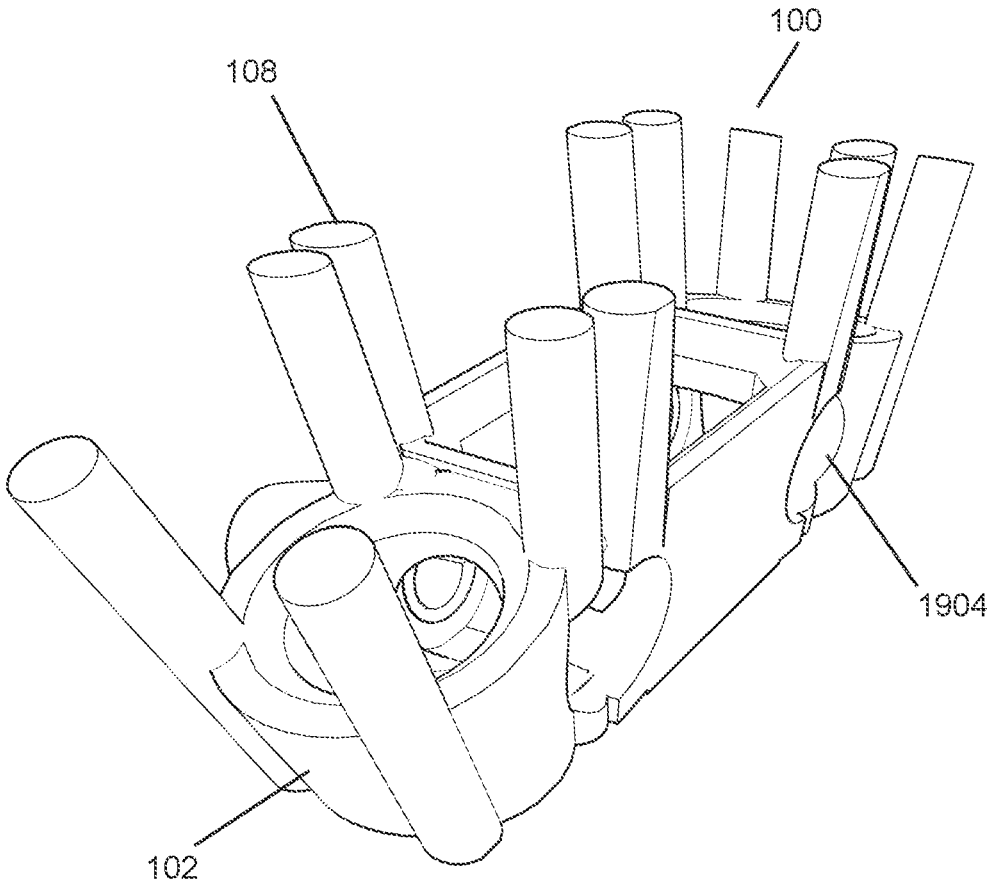
FIG. 20 depicts a rear perspective view of the block of FIG. 19.
Figure 21:
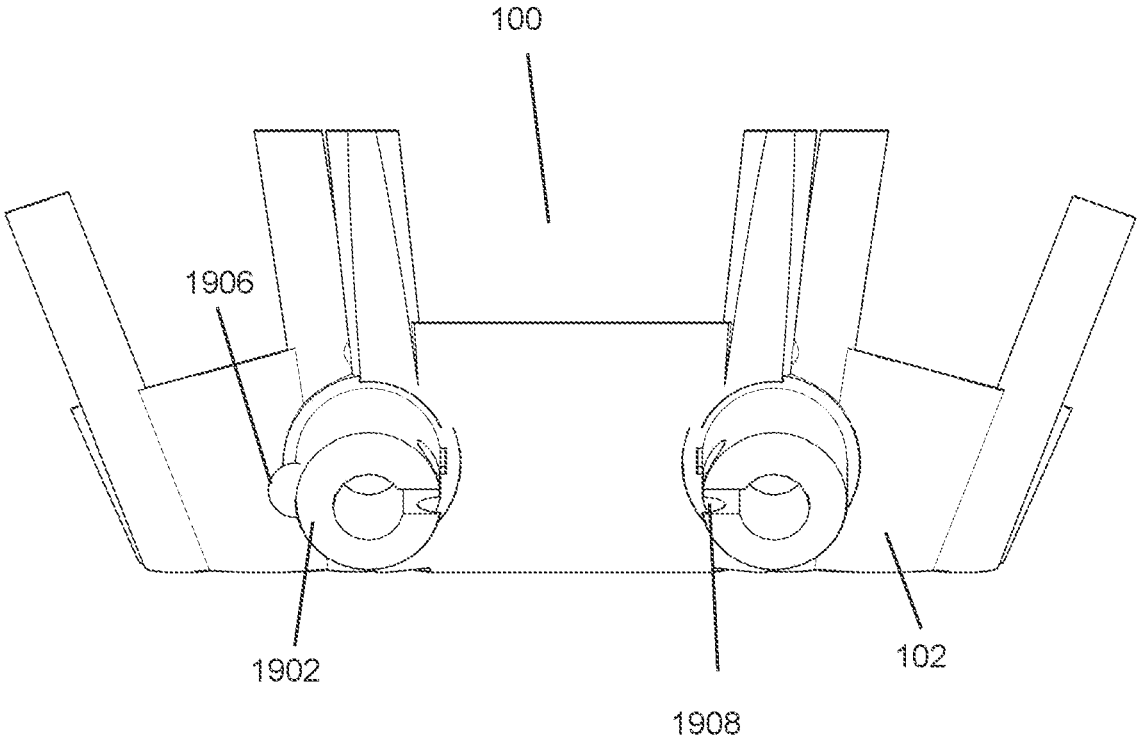
FIG. 21 depicts a front view of the block of FIG. 19.

As shown in FIGS. 20 and 22, the body 102 further comprises two tube openings 1904 formed on a rear face of body 102. The inner diameter and spacing of tube openings 1904 are such that tubes 1902 can be accommodated within tube openings 1904 for translational motion. Preferably, the inner diameter of tube opening 1904 is slightly greater than that of the outer diameter of tubes 1902. The width of body 102 is great enough such that it can accommodate the entire length of tubes 1902.

FIGS. 21, 24, 25, and 26 purposefully depict stopper 1906. Stopper 1906 is not integrally formed with block 100, but rather stopper 1906 is later added to each tube 1902 after adjacent blocks are joined together in order to prevent them from being separated. In order to assist a user with the correct placement of stopper 1906, a notch 1908 is optionally placed near the end of each tube 1902 which provides a visual indicator to the user for the placement of the stopper 1906 along the length of tube 1902. Tubes 1902 further comprise longitudinal openings 1910 which assist in preventing dirt and other debris from impacting springs 116.

Figure 27:
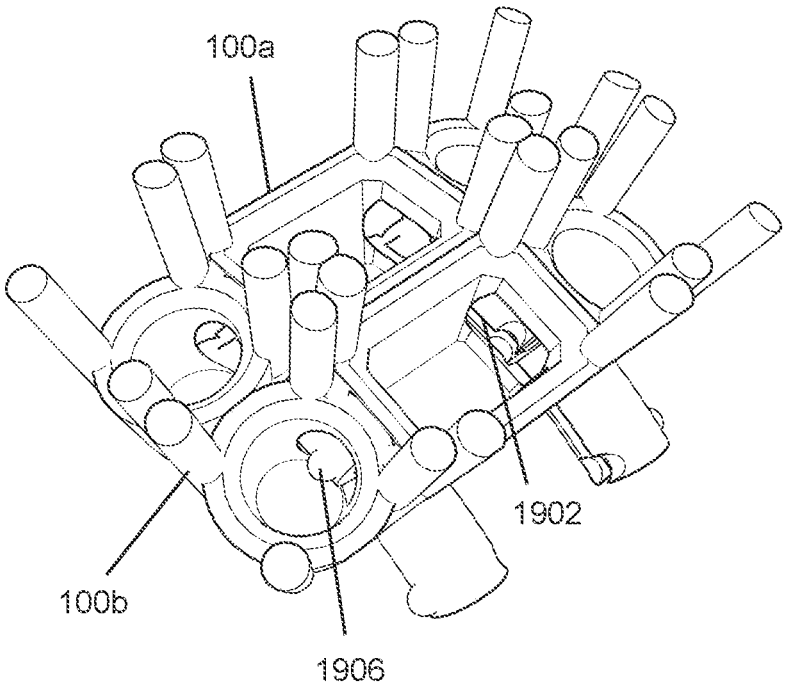
FIG. 27 depicts the coupling of two adjacent blocks of the expandable ring structure of the second embodiment
Figure 28:
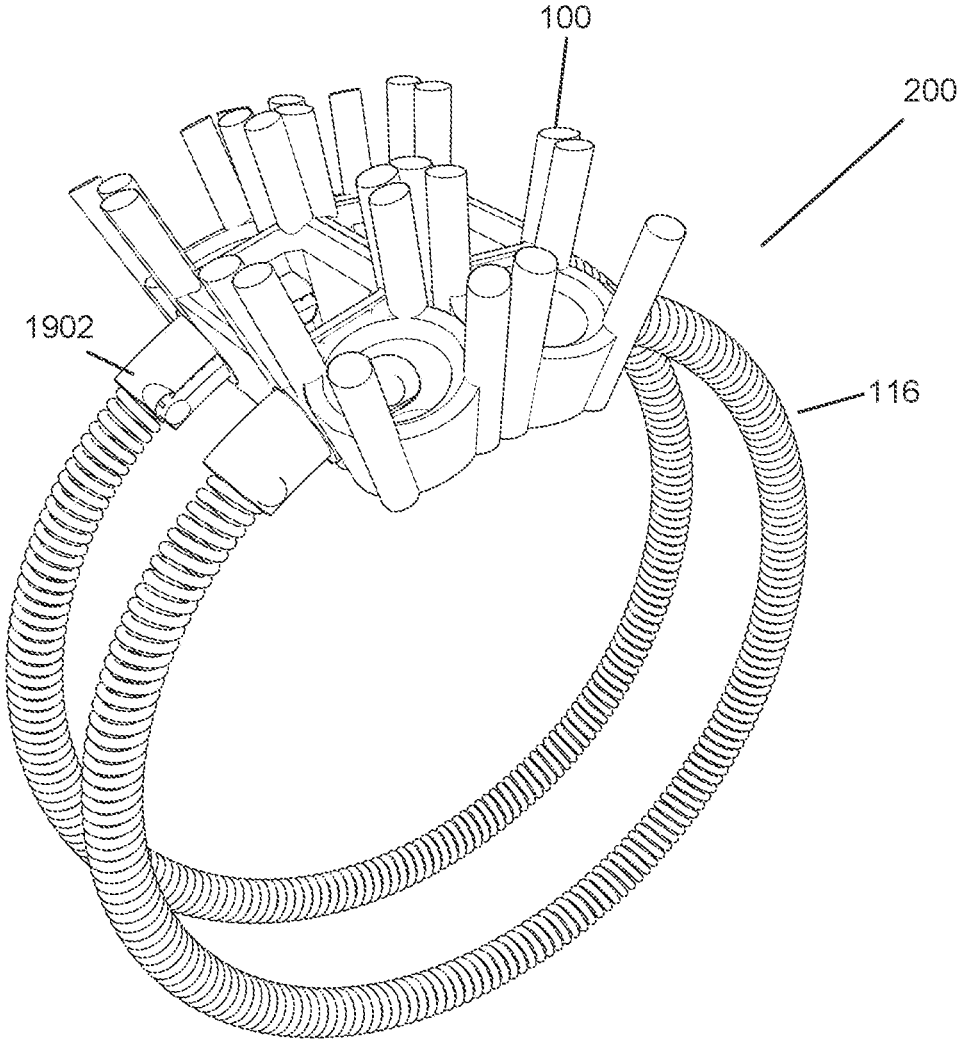
FIG. 28 depicts the placement of the springs passing through the spring openings of the blocks according to the second embodiment.

FIG. 27 depicts how a first block 100*a* is coupled to another block 100*b*. First, the tubes 1902 of first block 100*a* are inserted into tube openings 1904 of block 100*b*. Then, using notch 1908 as a guide, stopper 1906 is manually (or machine) added through laser welding a small ball of metal to the exterior of one or more tubes 1902 of first block 100*a*. This prevents the separation of first block 100*a* from second block 100*b* while still allowing for translational movement between the two.

Figure 29:
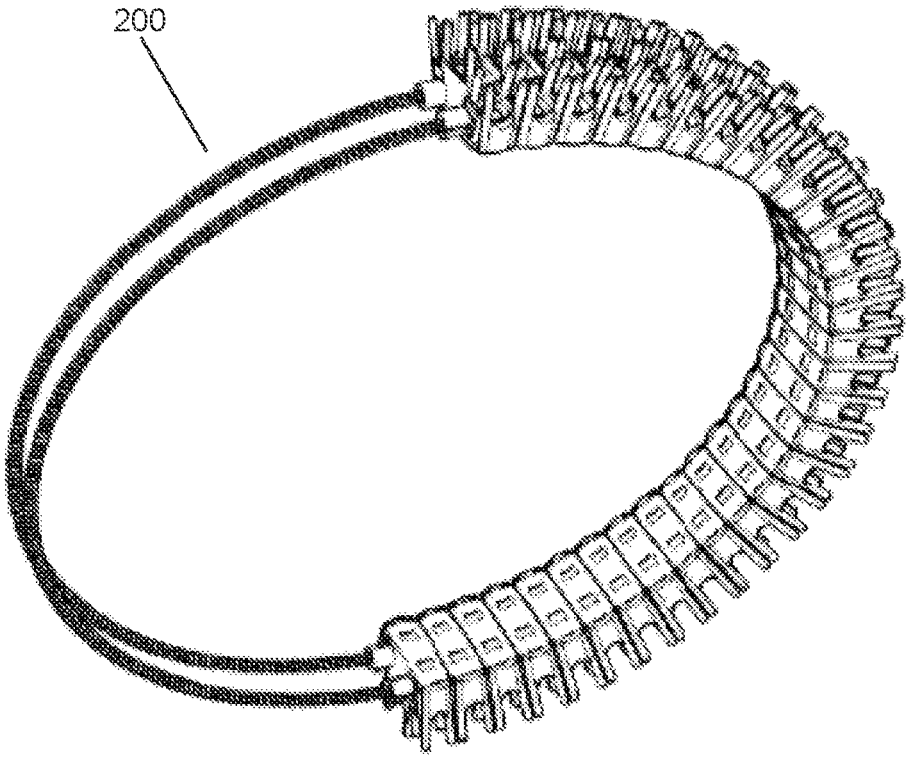
FIG. 29 depicts a side view of the completed expandable ring structure according to the second embodiment.

As already described, tubes 1902 are sized to accommodate springs 116 placed there through as depicted in FIG. 18. Thus, in this embodiment, the tubes 1902 simultaneously serve as the coupling element and the conduit for springs 116. To form the expandable ring structure 200 using the second embodiment of block 100, the following process is preferably utilized. First, all the blocks 100, except the first and the last, are joined together using stoppers 1906 as already described. One end of the springs 116 is fixed to the first block 100, passed through all tubes 1902, and then stretched and secured to the interior of the last block 100. The first and last block are then permanently joined together by soldering or laser welding. At this point, expandable ring structure 200 can be finished with jewels 118 to produce a finished piece of jewelry. FIG. 29 depicts a side view of a completed expandable ring structure 200 according to the second embodiment.

Figure 30:
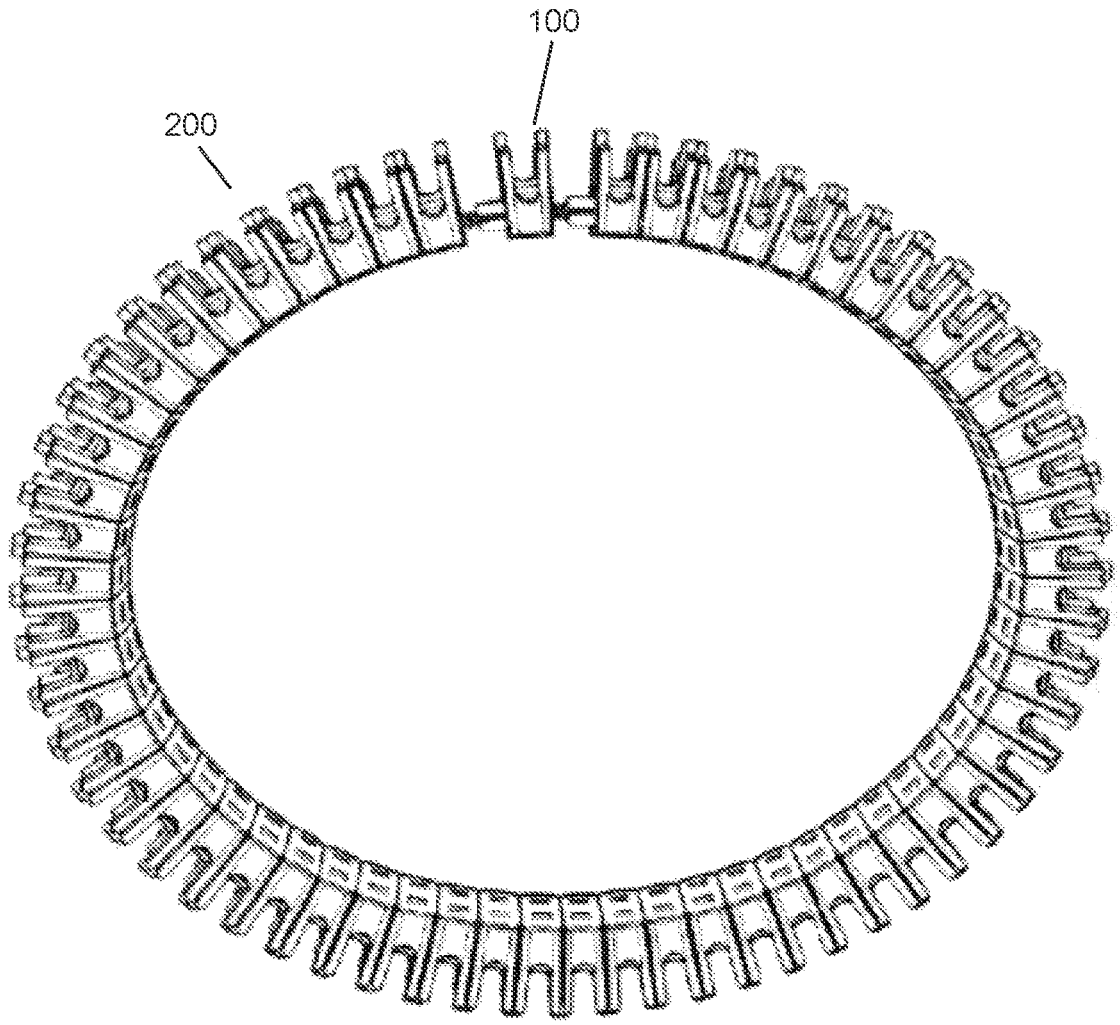
FIG. 30 depicts an alternate embodiment of a completed expandable ring structure.

FIG. 30 depicts an expandable ring structure 200 which utilizes a plurality of blocks 100 having a much smaller width than that depicted with reference to FIGS. 1-29. By greatly increasing the number of blocks 100, the relative curvature of the bottom of the body 102 becomes much smaller and the expandable ring structure 200 can be bent into a circular or oval shape while still maintaining a smooth interior as shown.

The invention claimed is:

1. An expandable ring structure comprising a plurality of coupled blocks, wherein each block comprises:

a first horizontal loop extending from a front face of the block;

a spring channel having a first opening located above a center of the first horizontal loop;

a loop opening on a rear face of the block accommodates an entirety of a horizontal loop from an adjacent block;

a second opening located above the loop opening forming an end of the spring channel; and a pin placed through a pin hole in a bottom of the block for retaining a second horizontal loop the adjacent block within the loop opening, wherein the pin prevents separation of the adjacent block from the block, and wherein the pin limits translational movement between the block and the adjacent block between a minimum distance and a maximum distance.

2. The expandable ring structure according to claim 1, wherein each block further comprises:

a plurality of prongs extending from a top surface of the block for retaining one or more gems.

3. The expandable ring structure according to claim 2, wherein each block further comprises a curved bottom surface.

4. The expandable ring structure according to claim 1, wherein the fig horizontal loop and the second horizontal loop are U-shaped.

5. The expandable ring structure according to claim 1, further comprising:

a helical spring for maintaining the expandable ring structure in a collapsed configuration, wherein the helical spring extends through the spring channel of each block.

6. The expandable ring structure according to claim 5, wherein an interior of each block is hollow.

7. A link for forming an expandable ring structure, wherein the link has a first end and a second end, wherein the link comprises:

a plurality of coupled blocks, each block comprising:

a body;

two loops protruding horizontally from a front face of the body;

two loop openings on a rear face of the body;

two spring channels extending from the front face of the body to the rear face of the body, wherein the two loops extend through the two loop openings in an adjacent block; and a pin extending through a pin hole in a bottom surface of the body retains the two loops of the adjacent block within the two loop openings; and two helical springs extending through the two spring channels of each block, wherein tension of the two helical springs retain the link in a collapsed configuration with each block in contact with one another.

8. The link according to claim 7, wherein each block comprises a curved bottom surface.

9. The link according to claim 8, wherein front and rear ends of each block subtend an angle in degrees is 360/N, where N is a number of blocks in the link.

10. The link according to claim 8, wherein a front face of a terminal block at a first end of the link is permanently coupled to a rear surface of a terminal block at a second end of the chain to form the expandable ring structure.

11. The link according to claim 10, wherein the expandable ring structure is a ring worn on a finger.

12. The link according to claim 11, wherein the expandable ring structure is a bracelet.

13. The link according to claim 12, wherein an interior of the expandable ring structure forms a smooth curved surface.

14. The link according to claim 10, wherein each block is formed from gold, silver, platinum, or titanium.

15. The link according to claim 10, wherein each block further comprises:

a plurality of prongs extending from a top surface of the block for retaining one or more gems; and a sprue having ends coupled to each of the plurality of prongs which terminate at a central post.

16. The link according to claim 8, wherein the two loops are curved downward toward a bottom of the body.

* * * * *